US009521872B1

(12) United States Patent
Andrews

(10) Patent No.: US 9,521,872 B1
(45) Date of Patent: Dec. 20, 2016

(54) WIND UP MITT

(71) Applicant: Daniel Patrick Andrews, Westminster, MD (US)

(72) Inventor: Daniel Patrick Andrews, Westminster, MD (US)

( * ) Notice: Subject to any disclaimer, the term of this patent is extended or adjusted under 35 U.S.C. 154(b) by 0 days.

(21) Appl. No.: 14/729,091

(22) Filed: Jun. 3, 2015

(51) Int. Cl.
*A41D 19/01* (2006.01)
*A41D 19/00* (2006.01)

(52) U.S. Cl.
CPC ..... *A41D 19/01* (2013.01); *A41D 19/0003* (2013.01); *A41D 19/0037* (2013.01)

(58) Field of Classification Search
CPC ..... A41D 19/00; A41D 19/01; A41D 19/002; A63B 71/146
USPC ..... 2/158, 159, 160, 161.4, 161.5
See application file for complete search history.

(56) References Cited

U.S. PATENT DOCUMENTS 5,010,617 A * 4/1991 Nelson ..... A47L 23/10 15/227
5,765,228 A * 6/1998 Bieling ..... A61H 1/0288 128/879
7,002,258 B2 * 2/2006 Mali ..... G11C 8/16 257/204
8,230,523 B2 * 7/2012 Chareyron ..... A47L 13/18 15/1.52
8,776,267 B2 * 7/2014 Narboni-Campora ..... A41D 13/085 2/158

FOREIGN PATENT DOCUMENTS

GB 955041 A * 4/1964 ..... A41D 13/085

* cited by examiner

*Primary Examiner* — Tejash Patel

(57) ABSTRACT

The Wind Up Mitt is an ambidextrous, single hand, mitt made of a plurality of materials with a stitched-in woven belting strap, which extends longitudinally within the length of the mitt, and further extends beyond the end of the mitt, and is equipped with either a buckle or hook and loop attachments. Corresponding buckles or hook and loop attachments are loop stitched onto both sides of the mitt's exterior to facilitate hand-loop winding, binding, and storage of linear flexible material items such as, but not limited to: electrical extension cords, electrical cables, stranded wire electrical holiday lights, ropes, cords, flexible hoses, flexible tubing, cloth measuring tapes, stranded electrical wire and solid electrical wire. This device, along with the wound up linear flexible material item, may be vertically hung on a receiving peg or hook for storage, and a hook and loop closure is stitched within the mitt's hand opening to help seal the mitt's interior during storage.

4 Claims, 14 Drawing Sheets

WIND UP MITT

BACKGROUND OF THIS INVENTION

This invention relates to a linear flexible material item, hand loop, wind-up, binding and storage device. Specifically, this invention relates to a Wind Up Mitt. There are existing strap binding inventions to bind and storage-hang linear flexible material items such as those disclosed in U.S. Pat. No. 3,197,830 "Keeper For Electrical Cords", U.S. Pat. No. 4,182,005 "Electrical Cord Holder", and U.S. Pat. No. 5,075,932 "Cord Holder". These strap binders offer utility, but could be more ergonomic in their design. There is also U.S. Pat. No. 9,198,473 entitled "Mitt", designed to be easily attached around a tubular bar. This hand mitt has attached fasteners to enclose a tubular bar, but doesn't use a binding strap. Consequently, the present inventor realized a need for a device that would facilitate the hand loop winding, binding, and storage of linear flexible material items by use of a hand mitt with an incorporated woven belting strap with an attachable end. Hence, this ambidextrous, single hand mitt provides two functions, viz; to facilitate the hand loop winding of linear flexible material items such as, but not limited to: electrical extension cords, electrical cables, stranded wire electrical holiday lights, ropes, cords, flexible hoses, flexible tubing, cloth measuring tapes, stranded electrical wire and solid electrical wire, and; to allow the wound-up linear flexible material item to be vertically hung on a receiving peg or hook for storage.

The mitt is made of a plurality of fabrics, canvas, vinyl and/or leather and has a stitched-in woven belting strap longitudinally within the mitt, which also extends beyond the mitt's exterior, with either a stitched-on plastic parachute buckle or hook and loop attachments. There are similar corresponding receiving attachments on both the palm piece and back piece of the mitt. The extended portion of the woven belting strap is intended to be attached around the wound-up linear flexible material item to bind it in a wound position. Also, hook and loop type strips are stitched within the mitt's hand opening interior perimeter to help keep debris and/or insects out of the interior of the mitt during storage. And, hang up rings are loop attached so the device, along with a wound-up linear flexible material item, can be vertically hung on a receiving hook or peg.

Therefore, the principle objective of the present invention is to provide a device that facilitates hand-loop winding of linear flexible material items.

Another objective of the present invention is to provide a device that facilitates vertical hanging storage of linear flexible material items.

Another objective of the present invention is to provide a device that facilitates less entanglement of linear flexible material items.

Lastly, another objective of the present invention is to provide for an affordable means to organize linear flexible material items.

BRIEF DESCRIPTION OF THE INVENTION

The Wind Up Mitt is a practical, ambidextrous, single hand mitt with a stitched-in woven belting strap which is equipped with either plastic parachute buckles or hook and loop attachments to facilitate hand loop winding, binding and storage of linear flexible material items such as, but not limited to electrical extension cords, electrical cables, stranded wire electrical holiday lights, ropes, cords, flexible hoses, flexible tubing stranded electrical wire and solid electrical wire. The mitt, along with the wound-up linear flexible material item, may be vertically hung on a receiving peg or hook for storage. A hook and loop closure is stitched within the interior perimeter of the mitt's hand opening to help keep debris and/or insects out of the mitt interior during storage.

DESCRIPTION OF THE INVENTION

Figure 1:
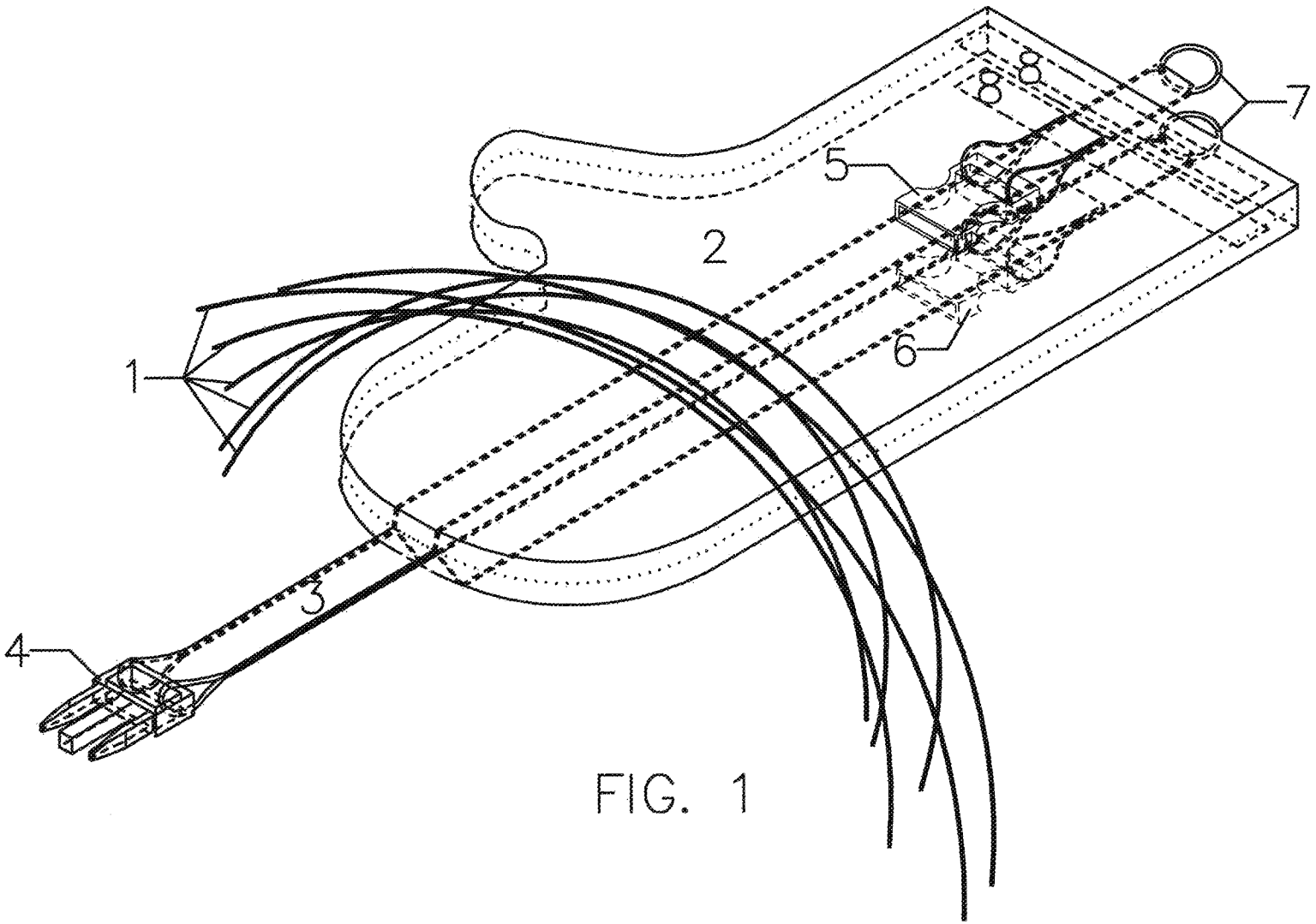
FIG. 1 is shown on sheet numbered 1-14 as a front page perspective view of the Wind Up Mitt with plastic parachute buckle attachments and a partially shown linear flexible material item.
Figure 2:
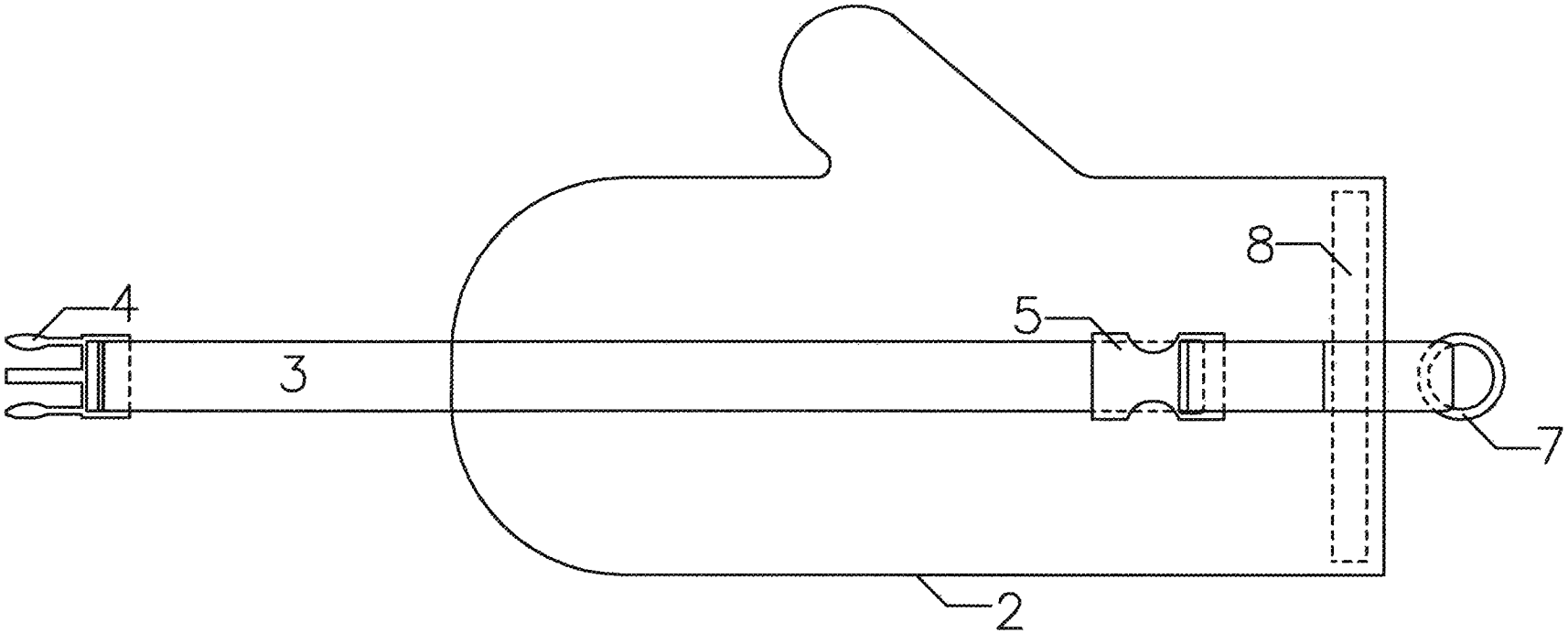
FIGS. 2, 3, 4, and 5 are shown on sheets numbered 2-14, 3-14, 4-14, 5-14, as plan view top, plan view bottom, elevation view and perspective view, respectively, of the Wind Up Mitt with plastic parachute buckle attachments.
Figure 3:
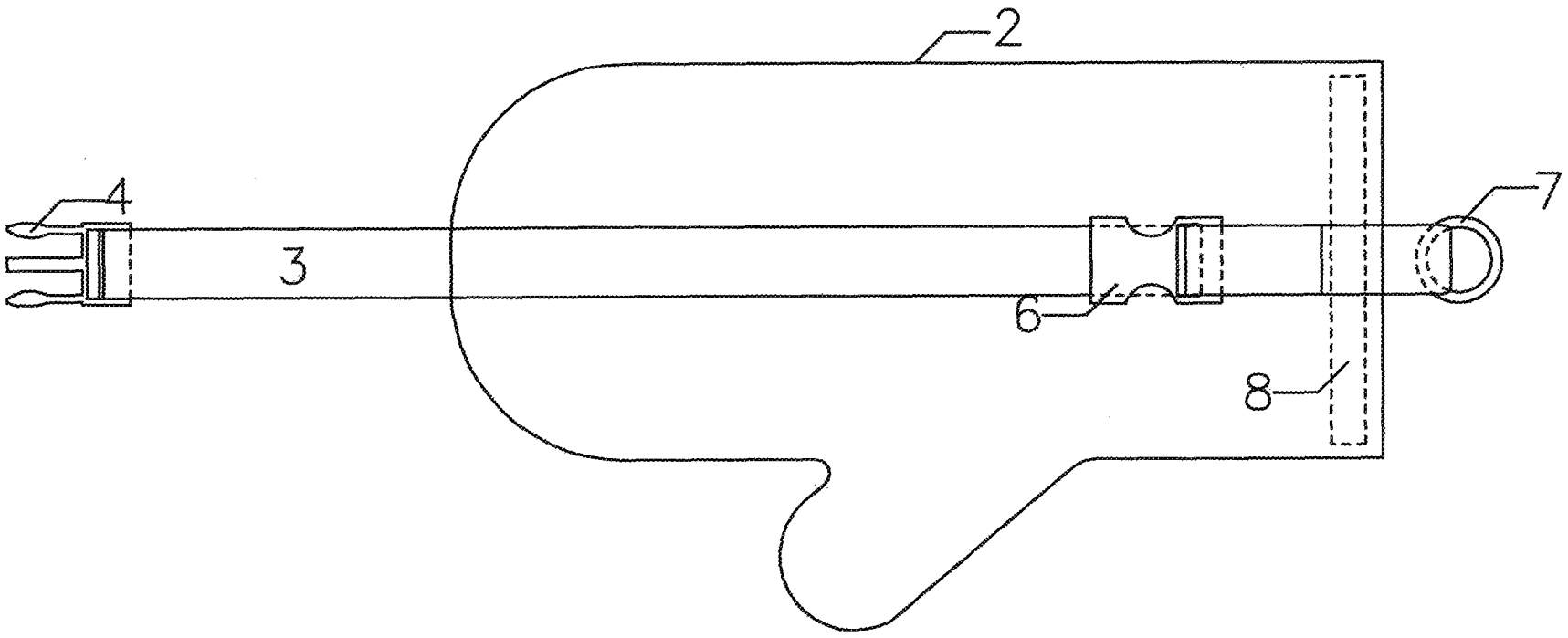
Figure 4:
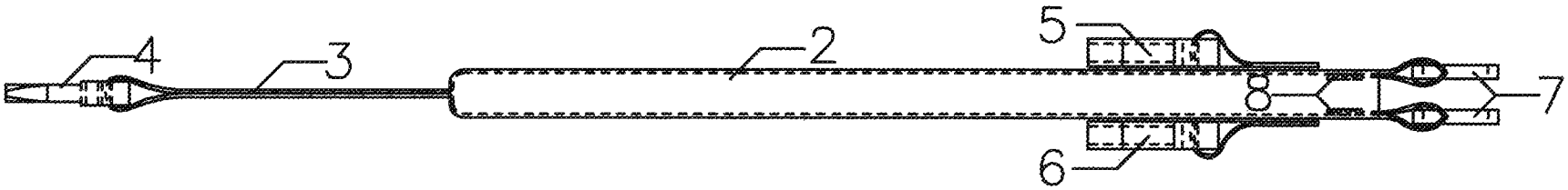
Figure 5:
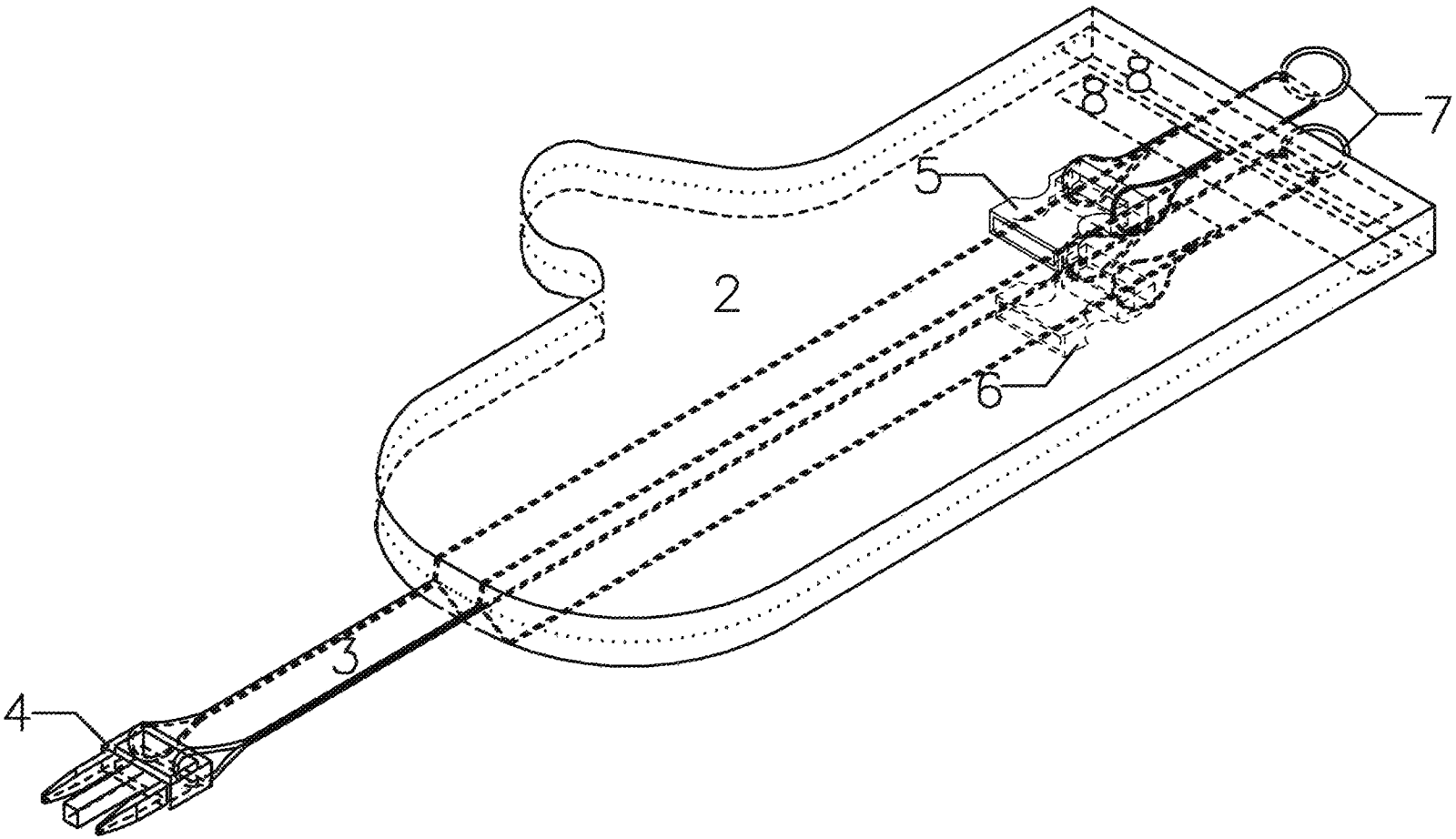
Figure 6:
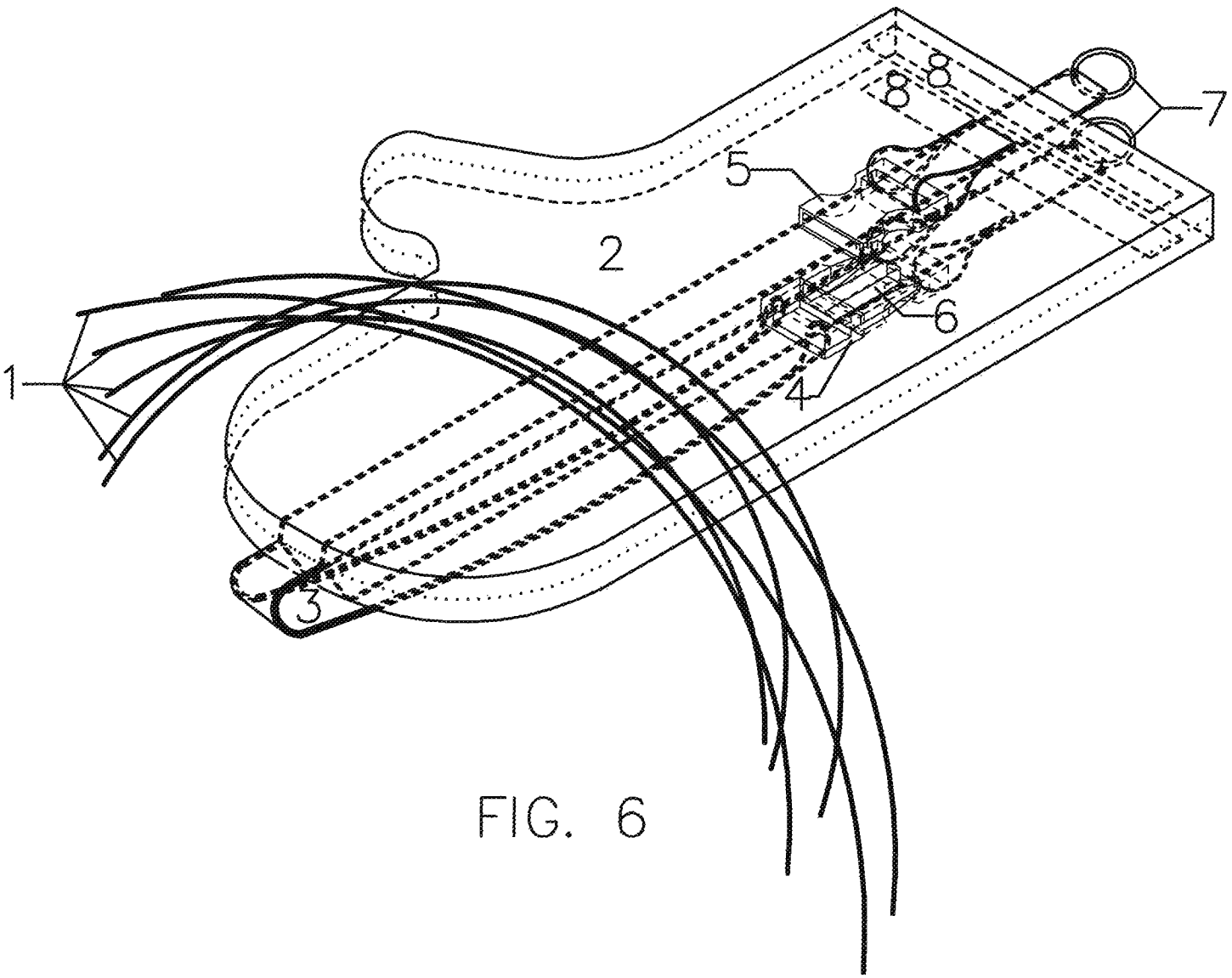
FIG. 6 is shown on sheet numbered 6-14 as a perspective view of the Wind Up Mitt with plastic parachute buckle attachments, and, with a partially shown linear flexible material item with the extended woven belting strap shown in a back-upon-itself position.
Figure 7:
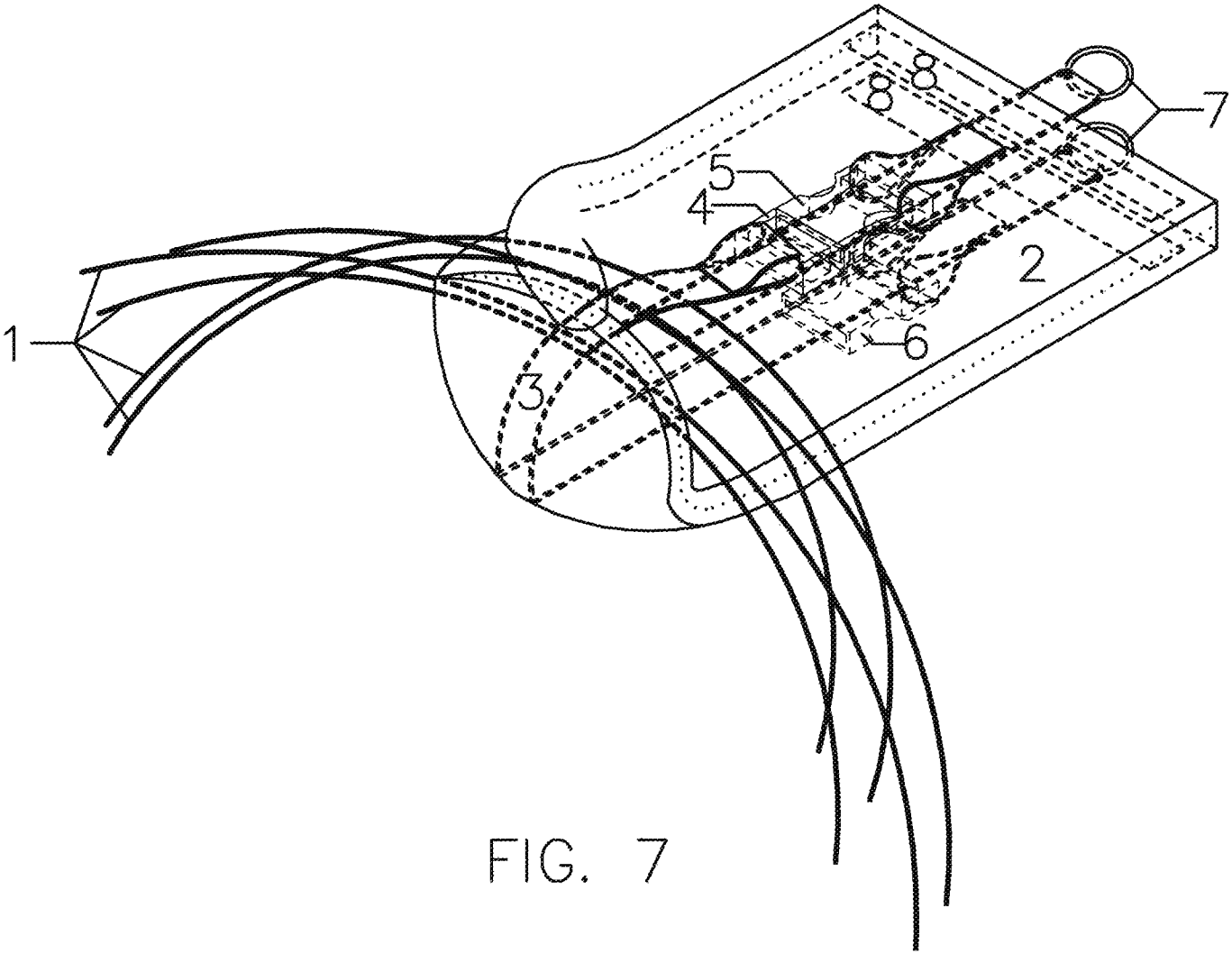
FIG. 7 is shown on sheet numbered 7-14 as a perspective view of the Wind Up Mitt with plastic parachute buckle attachments, and, with a partially shown flexible material item in a wound and bound position.
Figure 8:
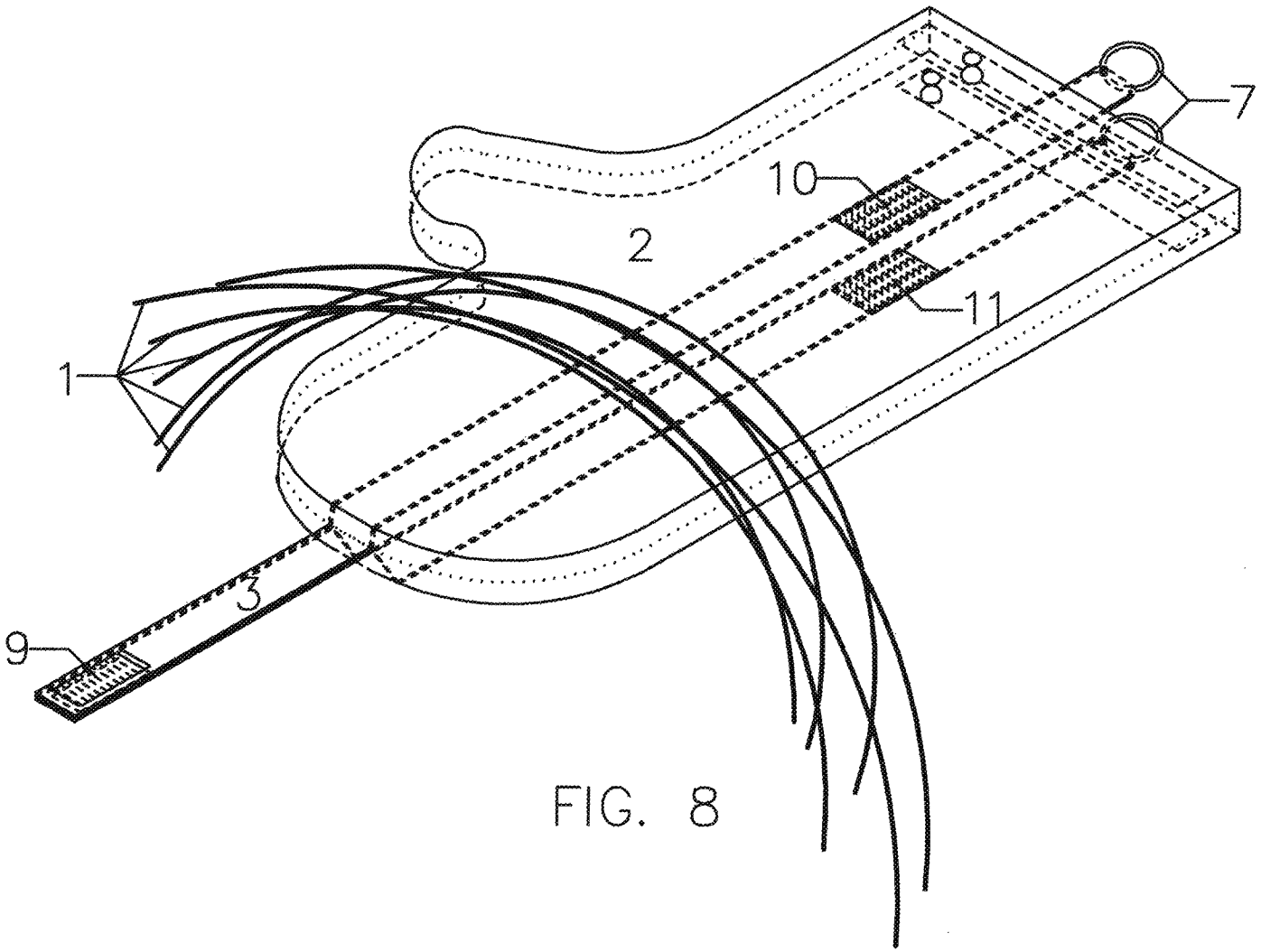
FIG. 8 is shown on sheet numbered 8-14 as a front page perspective view of the Wind Up Mitt with hook and loop attachments and a partially shown linear flexible material item.
Figure 9:
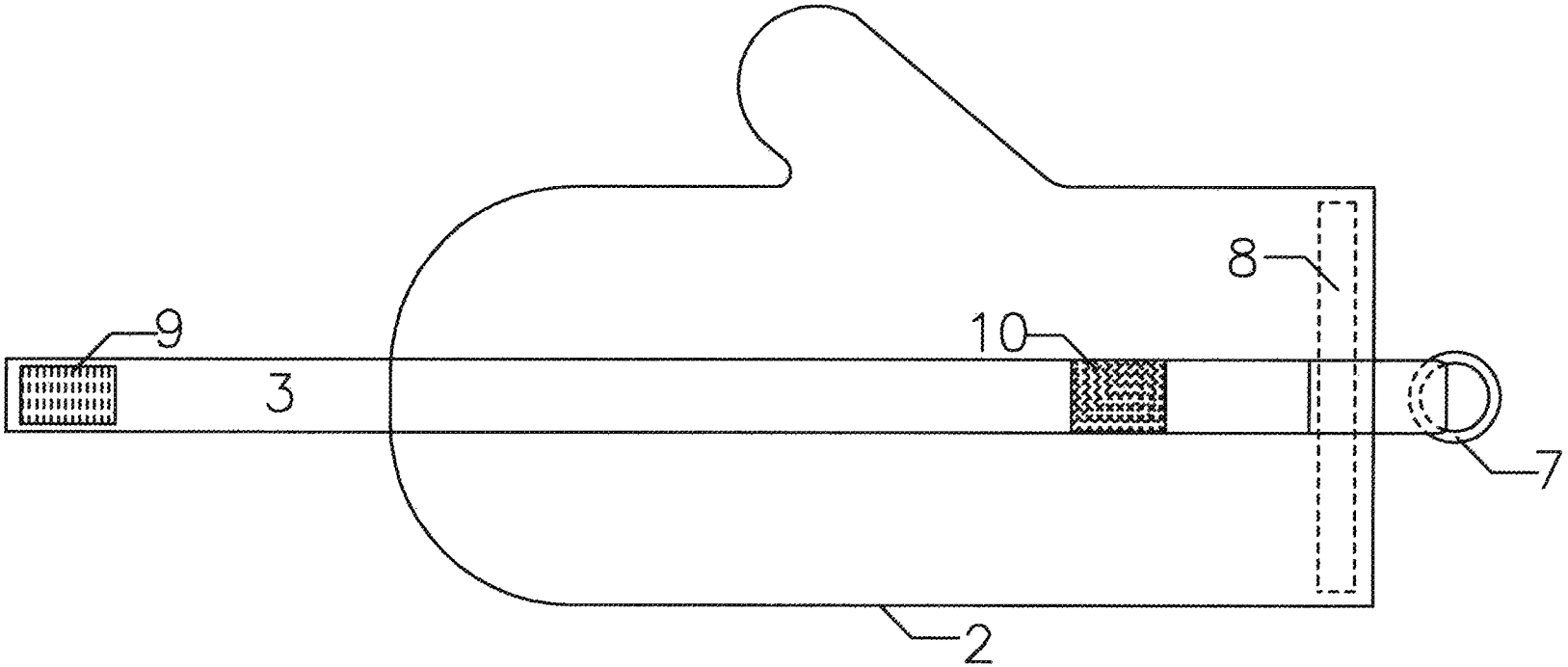
FIGS. 9, 10, 11 and 12 are shown on sheets numbered 9-14, 10-14, 11-14 and 12-14 as plan view top, plan view bottom, elevation view and perspective view, respectively, of the Wind Up Mitt with hook and loop attachments.
Figure 10:
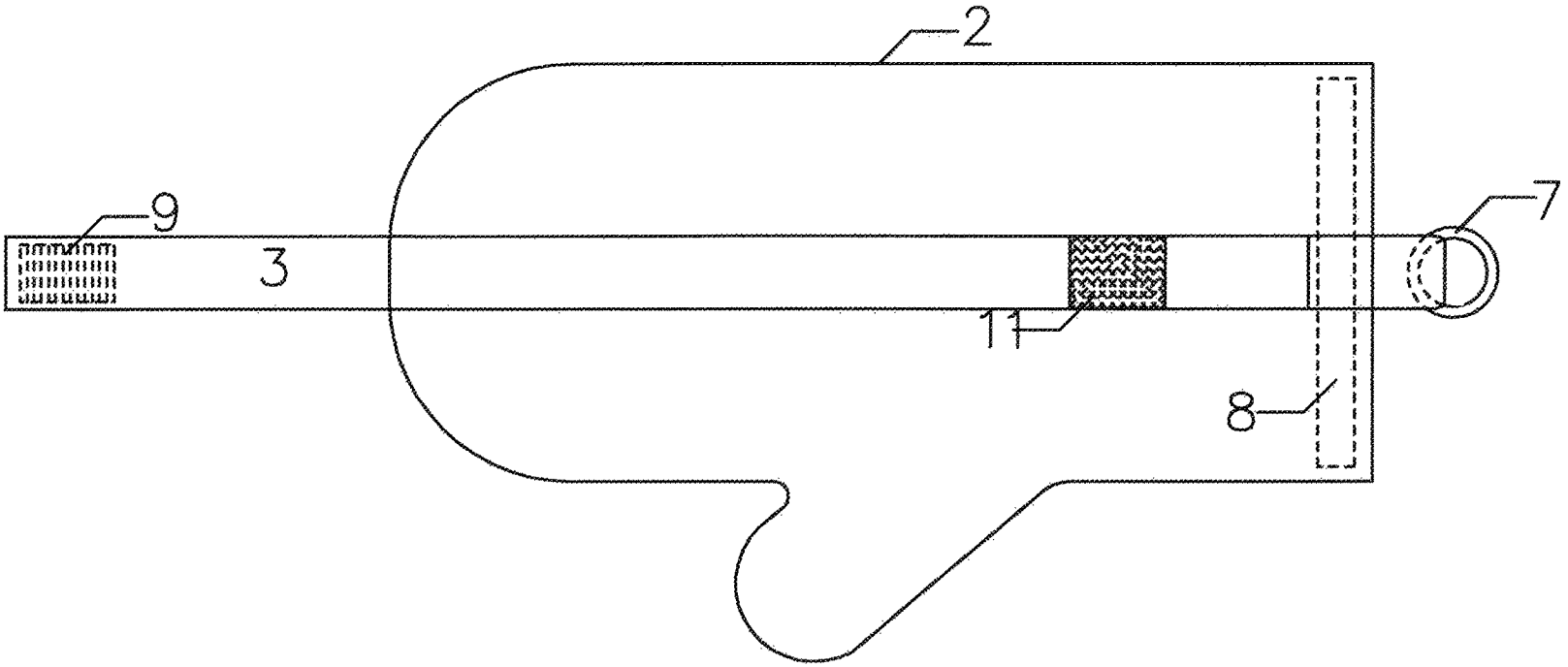
Figure 11:
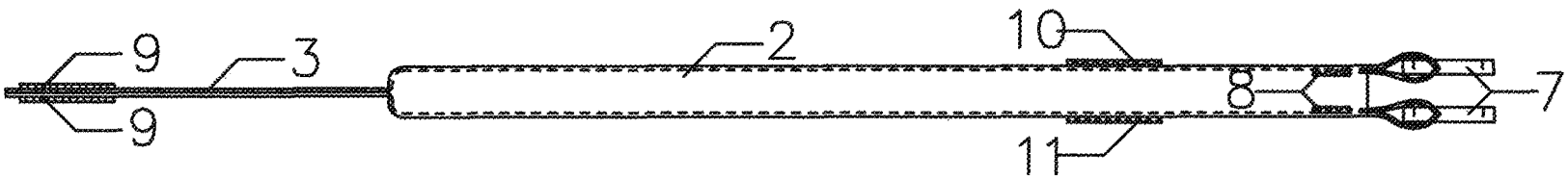
Figure 12:
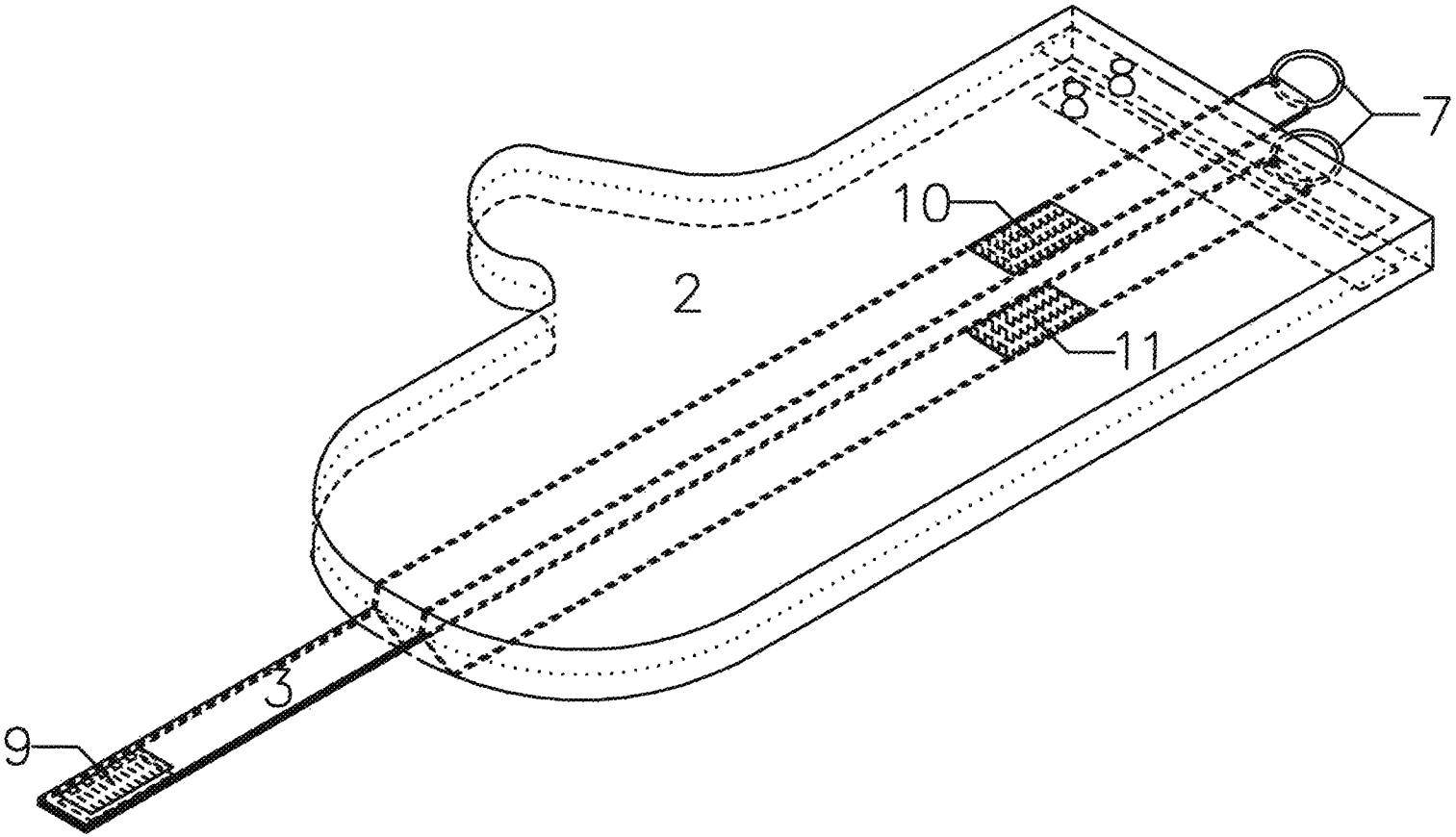
Figure 13:
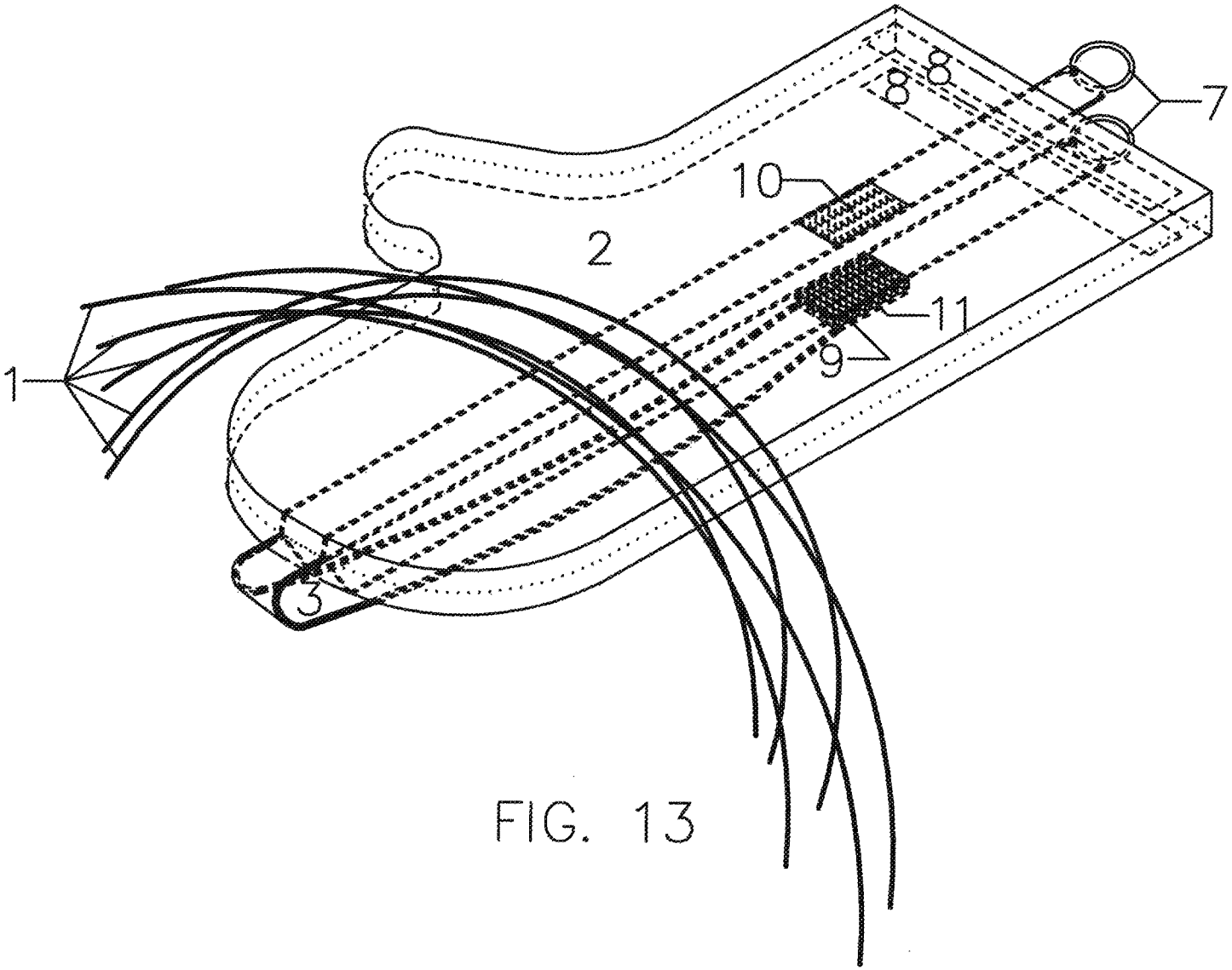
FIG. 13 is shown on sheet numbered 13-14 as a perspective view of the Wind Up Mitt with hook and loop attachments, and, with a partially shown linear flexible material item with the extended woven belting strap shown in a back-upon-itself position.
Figure 14:
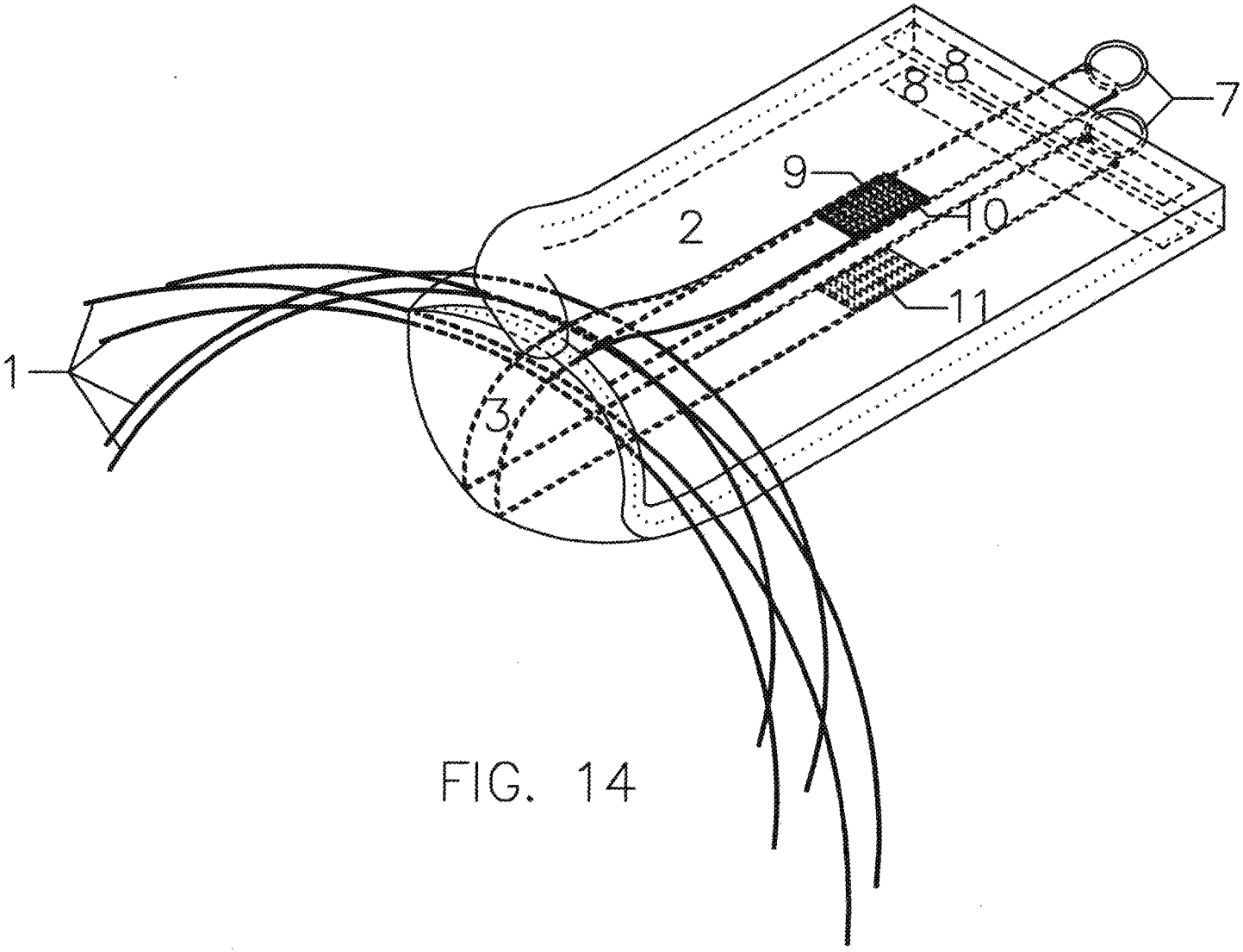
FIG. 14 is shown on sheet numbered 14-14 as a perspective view of the Wind Up Mitt with hook and loop attachments and, with a partially shown linear flexible material item in a wound and bound position.

The Wind Up Mitt is intended to be used to help hand loop wind-up, bind and store a plurality of linear flexible material items 1. This invention has two different woven belting strap attachment options which are separately described and designated as FIGS. 1 through 7 and FIGS. 8 through 14.

FIGS. 1, 2, 3, 4, 5, 6 & 7 show a linear flexible material item 1, a palm piece and back piece stitched together to form a hand mitt 2 made of heavy fabric, canvas, vinyl and/or leather, a stitched-in variable width woven belting strap 3 longitudinally within the mitt 2 and further extends beyond the mitt 2, a loop stitched-on variable width male plastic parachute buckle attachment 4, a loop stitched-on variable width female plastic parachute buckle palm piece attachment 5, a loop stitched-on female plastic parachute buckle back piece attachment 6, loop stitched-on hanging rings 7 made of metal, wood or plastic, and a male hook and female loop mitt hand opening closure 8 stitched within the perimeter of the hand opening of the mitt 2 to help keep debris and/or insects out of the mitt's interior during storage.

To allow the mitt to be used ambidextrously, the variable width female plastic parachute buckle attachment 6 is loop stitched-on the back piece of the mitt 2 to allow the woven belting strap 3 and male parachute buckle 4 to be attached in a back-upon-itself position. This positioning is useful during the hand winding procedure to secure the woven belting strap 3. Also, the variable width woven belting strap 3 which extends beyond the mitt's may be manufactured to varying lengths, or be length adjustable, exterior to the mitt 2, to accommodate various sizes, weights, and lengths of a plurality of linear flexible material items 1.

In practice, with both hands, the user grasps the mitt 2 near the mitt's hand opening and pulling action, pulls apart the male hook and female loop closure 8, stitched within the interior of the mitt, and then fully inserts his/her hand (either right or left) into the mitt 2. With their exposed hand, they pick up the linear flexible material item 1 and begin the process of hand loop winding the linear flexible material item 1 between the thumb and palm piece of the mitt 2 thereby creating a linear flexible material item 1 elliptical shaped loop of approximately three feet in circumference. The user continues hand loop winding up the linear flexible material item 1 throughout its entire length until it is completely wound around the mitt 2 in an elliptical fashion.

With their exposed hand, the user then reaches through the center opening created by the elliptical loop winding of the linear flexible material item 1 and grasps the variable width woven belting strap 3 and the male plastic parachute buckle 4 and disconnects male parachute buckle 4 from the female parachute buckle 6. This undoes the back-upon-itself positioning. The user then pulls the variable width woven belting strap 3 and variable width male plastic parachute buckle 4 through the said elliptical opening and binds it around the wound-up linear flexible material item 1 and connects the variable width male plastic parachute buckle 4 into the variable width female plastic parachute buckle 5 to bind and secure the linear flexible material item 1 in a wound position. Again, with their exposed hand, the user then grasps a single hang up ring 7 and by a pulling action, extracts their other hand from within the mitt 2. The user then presses together, with both hands, the male hook and female loop closure 8 to help seal the mitt's 2 interior Lastly, with either hand, the user grasps both hang up rings 7 with their finger and hangs the entire mitt 2 along with the wound, bound and secured linear flexible material item 1 on a receiving vertical peg or hook (not shown) for storage.

FIGS. 8, 9, 10, 11, 12, 13 & 14 show a linear flexible material item 1, a palm piece and back piece stitched together to form a hand mitt 2 made of heavy fabric, canvas, vinyl or leather, a stitched-in variable width woven belting strap 3 longitudinally within the mitt 2 and further extends beyond the mitt 2, a stitched-on double-sided male hook attachment 9, a stitched-on female loop palm piece attachment 10, a stitched-on female loop back piece attachment 11, loop stitched-on hanging rings made of metal, wood or plastic 7, and a male hook and female loop type mitt hand opening closure 8 stitched within the perimeter of the hand opening of the mitt, to help keep debris and/or insects out of the mitt interior during storage.

To allow the mitt to be used ambidextrously, the female loop attachment 11 is stitched-on the back piece of the mitt 2 to allow the woven belting strap 3 and the male hook attachment 9 to be attached in a back-upon-itself position. This positioning is useful during the hand winding procedure to secure the woven belting strap 3. Also, the variable width woven belting strap 3 which extends beyond the mitt's finger end may be manufactured to varying lengths, or be length adjustable, exterior to the mitt 2, to accommodate various sizes, weights and lengths of a plurality of linear flexible material items 1.

In practice, with both hands, the user grasps the mitt 2 near the mitt's hand opening and by pulling action, pulls apart the male hook and female loop closure 8, stitched within the interior of the mitt, and fully inserts his/her hand (either right or left) into the mitt 2. With their exposed hand, they pick up the linear flexible material item 1 and begin the process of hand-loop winding the linear flexible material item 1 between the thumb and palm piece of the mitt 2 thereby creating a linear flexible material item 1 elliptical shaped loop of approximately three feet in circumference. The user continues hand loop winding up the linear flexible material item 1 throughout its entire length until it is completely wound around the mitt 2 in an elliptical fashion.

With their exposed hand, the user then reaches through the center opening created by the elliptical loop winding of the linear flexible material item 1 and grasps the variable width woven belting strap 3 and male hook attachment 9, and by pulling action, disconnects the male hook attachment 9 from the female loop attachment 11. This undoes the back-up-itself positioning. The user pulls the variable width woven belting strap 3 and male hook attachment 9 through the elliptical opening and around the wound-up linear flexible material item 1 and press attaches the male hook attachment 9 onto female loop attachment 10 to bind and secure the linear flexible material item 1 in a wound position. Again, with their exposed hand, the user then grasps a single hang up ring 7 and by pulling action, extracts their other hand from within the mitt 2. The user then presses together with both hands, the Velcro male hook and female loop closure 8 to seal the mitt 2 interior Lastly, with either hand, the user grasps both hang up rings 7 with their finger and hangs the entire mitt 2 along with the wound, bound and secured linear flexible material item 1 on a receiving vertical peg or hook (not shown) for storage.

What is claimed is:

1. A Wind Up Mitt device comprising:

a.~ an ambidextrous, single hand mitt having a palm piece, back piece, a stitched-in woven belting strap extending longitudinally within said mitt, which further extends beyond the said mitt's exterior, and terminates with a male buckle end; and b.~ a loop stitched-on female buckle on the palm piece of said mitt, wherein this female buckle is able to receive the said male buckle end and the said woven belting strap such that the said mitt's palm piece and said woven belting strap are adapted to bind a linear flexible material item; and c.~ a loop stitched-on female buckle on the back piece of said mitt, wherein the said female buckle is able to receive and secure the said male buckle end and said woven belting strap, in a back-upon-itself position, when the mitt is being used during the hand winding procedure.

2. The Wind Up Mitt device in claim 1 has hook and loop attachment closure strips stitched within the hand opening interior of the said mitt to help seal said mitt interior during storage.

3. A Wind Up Mitt device comprising:

a.~ an ambidextrous, single hand mitt having a palm piece, back piece, stitched-in woven belting strap extending longitudinally within said mitt, which further extends beyond the said mitt's exterior, and terminates with a double-sided hook and loop attachment end; and b.~ a stitched-on hook and loop attachment on the palm piece of said mitt, wherein this hook and loop attachment is able to receive the said hook and loop attachment end and the said woven belting strap such that the said mitt's palm piece and said woven belting strap are adapted to bind a linear flexible material item; and c.~ a stitched-on hook and loop attachment on the back piece of said mitt, wherein this hook and loop attachment is able to receive and secure the said hook and loop attachment end and said woven belting strap, in a back-upon-itself position, when the mitt is being used during the hand winding procedure.

4. The Wind Up Mitt device in claim 3 has hook and loop attachment closure strips stitched within the hand opening interior of the said mitt to help seal said mitt interior during storage.

* * * * *